US006305185B1

(12) United States Patent
Sloan

(10) Patent No.: US 6,305,185 B1
(45) Date of Patent: Oct. 23, 2001

(54) COOLER DEVICE WITH INTEGRATED SOLAR POWER AND STEREO SYSTEM

(76) Inventor: Dwight Sloan, 4415 Brockton Ave., Riverside, CA (US) 92501

( * ) Notice: Subject to any disclaimer, the term of this patent is extended or adjusted under 35 U.S.C. 154(b) by 0 days.

(21) Appl. No.: 09/575,564

(22) Filed: May 22, 2000

(51) Int. Cl.[7] ..... F25D 3/08
(52) U.S. Cl. ..... 62/457.7; 62/235.1; 62/457.1
(58) Field of Search ..... 62/457.7, 451.1, 62/235.1, 236, 371

(56) References Cited

U.S. PATENT DOCUMENTS 5,153,561 * 10/1992 Johnson ..... 340/571
5,235,822 * 8/1993 Leonovich, Jr. ..... 62/457.7
5,447,041 * 9/1995 Piechota ..... 62/457.7
5,636,852 * 6/1997 Sistrunk ..... 280/30
5,781,853 * 7/1998 Johnson ..... 455/351
6,021,642 * 2/2000 Guinn ..... 62/3.6

* cited by examiner

*Primary Examiner*—Henry Bennett
*Assistant Examiner*—Melvin Jones
(74) *Attorney, Agent, or Firm*—Goldstein Law Offices P.C.

(57) ABSTRACT

A cooler device with integrated solar power and stereo system including a cooler portion comprised of an open upper end, a closed lower end, a front wall, a rear wall, opposed side walls, a hollow interior, and a pair of carrying handles on the opposed side walls. The open upper end has a lid hingedly coupled thereto. A solar panel is secured to an upper surface of the lid of the cooler portion. A stereo system is disposed within the front wall of the cooler portion. The stereo system is in communication with the solar panel in conjunction with an internal storage battery. A trickle charger is provided to allow the internal storage battery to be charged with household current. A compass and thermometer is provided on at least one of the carrying handles.

4 Claims, 2 Drawing Sheets

COOLER DEVICE WITH INTEGRATED SOLAR POWER AND STEREO SYSTEM

BACKGROUND OF THE INVENTION

The present invention relates to a cooler device with integrated solar power and stereo system and more particularly pertains to storing food items while also providing entertainment and a power source.

The use of combination cooler devices is known in the prior art. More specifically, combination cooler devices heretofore devised and utilized for the purpose of containing food items and providing other functions are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,235,822 to Leonoich, Jr. discloses a combined cooler and audio system capable of being powered by solar energy. U.S. Pat. No. 5,636,852 to Sistrunk discloses an equipment transporting device for such items as a cooler and appears comprised of a solar cell for energizing various appliances such as a radio. U.S. Pat. No. 5,447,041 to Piechota discloses a combination insulated cooler and audio system located in a recessed cavity in the cover.

While these devices fulfill their respective, particular objective and requirements, the aforementioned patents do not describe a cooler device with integrated solar power and stereo system for storing food items while also providing entertainment and a power source.

In this respect, the cooler device with integrated solar power and stereo system according to the present invention substantially departs from the conventional concepts and designs of the prior art, and in doing so provides an apparatus primarily developed for the purpose of storing food items while also providing entertainment and a power source.

Therefore, it can be appreciated that there exists a continuing need for a new and improved cooler device with integrated solar power and stereo system which can be used for storing food items while also providing entertainment and a power source. In this regard, the present invention substantially fulfills this need.

SUMMARY OF THE INVENTION

In the view of the foregoing disadvantages inherent in the known types of combination cooler devices now present in the prior art, the present invention provides an improved cooler device with integrated solar power and stereo system. As such, the general purpose of the present invention, which will be described subsequently in greater detail, is to provide a new and improved cooler device with integrated solar power and stereo system which has all the advantages of the prior art and none of the disadvantages.

To attain this, the present invention essentially comprises a cooler portion comprised of an open upper end, a closed lower end, a front wall, a rear wall, opposed side walls, and a hollow interior. The open upper end has a lid hingedly coupled thereto. The hollow interior is divided into a first compartment and a second compartment. The first compartment is insulated for storing food items therein. One of the opposed side walls has a drainage tube extending outwardly therefrom. The drainage tube is in communication with the first compartment. The opposed side walls each have a carrying handle coupled thereto. A thermometer and compass are present in at least one of the carrying handles. The closed lower end has a pair of wheels coupled thereto. A solar panel is secured to an upper surface of the lid of the cooler portion. A stereo system is disposed within the front wall of the cooler portion. The stereo system is in communication with the solar panel in conjunction with an internal storage battery. A power outlet is disposed within one of the opposed side walls of the cooler portion. The power outlet is in communication with the solar panel. A light is secured to one of the opposed side walls of the cooler portion. The light is in communication with the solar panel. A storage compartment is disposed within the rear wall of the cooler portion. The storage compartment is defined by a folding door having a handle secured thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cooler device with integrated solar power and stereo system which has all the advantages of the prior art combination cooler devices and none of the disadvantages.

It is another object of the present invention to provide a new and improved cooler device with integrated solar power and stereo system which may be easily and efficiently manufactured and marketed.

It is a further object of the present invention to provide a new and improved cooler device with integrated solar power and stereo system which is of durable and reliable construction.

An even further object of the present invention is to provide a new and improved cooler device with integrated solar power and stereo system which is susceptible of a low cost of manufacture with regard to both materials and labor, and which accordingly is then susceptible of low prices of sale to the consuming public, thereby making such a cooler device with integrated solar power and stereo system economically available to the buying public.

Even still another object of the present invention is to provide a new and improved cooler device with integrated solar power and stereo system for storing food items while also providing entertainment and a power source.

Lastly, it is an object of the present invention to provide a new and improved cooler device with integrated solar power and stereo system including a cooler portion comprised of an open upper end, a closed lower end, a front wall, a rear wall, opposed side walls, and a hollow interior. The open upper end has a lid hingedly coupled thereto. A solar panel is secured to an upper surface of the lid of the cooler portion. A stereo system is disposed within the front wall of the cooler portion. The stereo system is in communication with the solar panel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figures 1, 2:
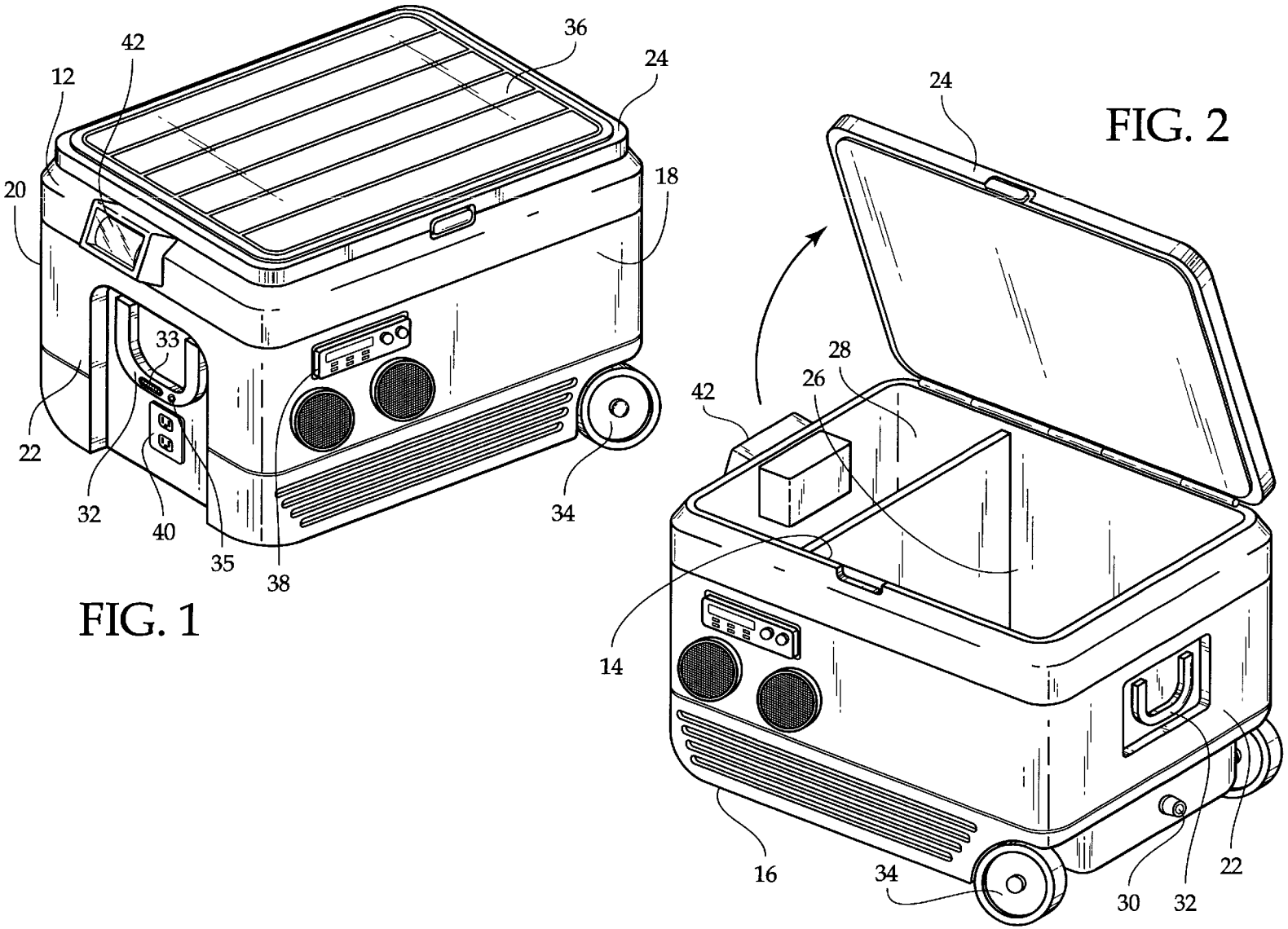
FIG. 1 is a perspective view of the preferred embodiment of the cooler device with integrated solar power and stereo system constructed in accordance with the principles of the present invention.
FIG. 2 is a perspective view of the present invention illustrated with the lid in a raised orientation.
Figure 3:
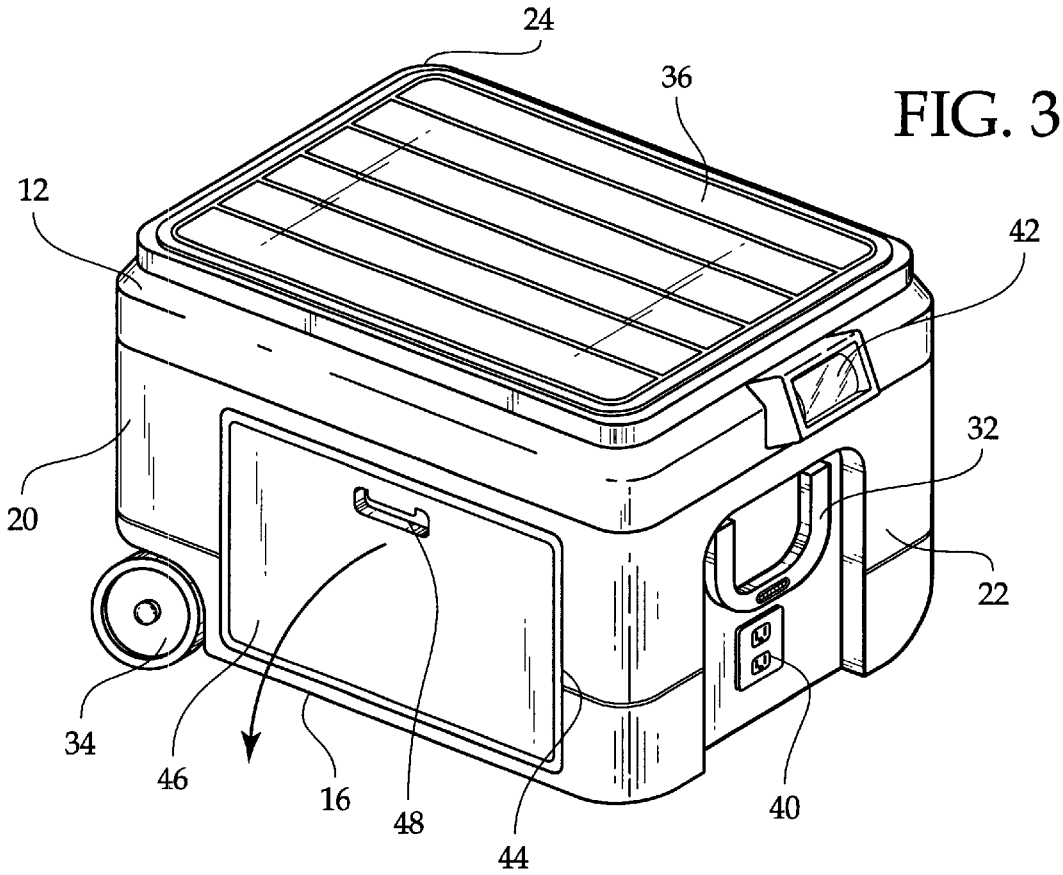
FIG. 3 is rear perspective view of the present invention.
Figure 4:
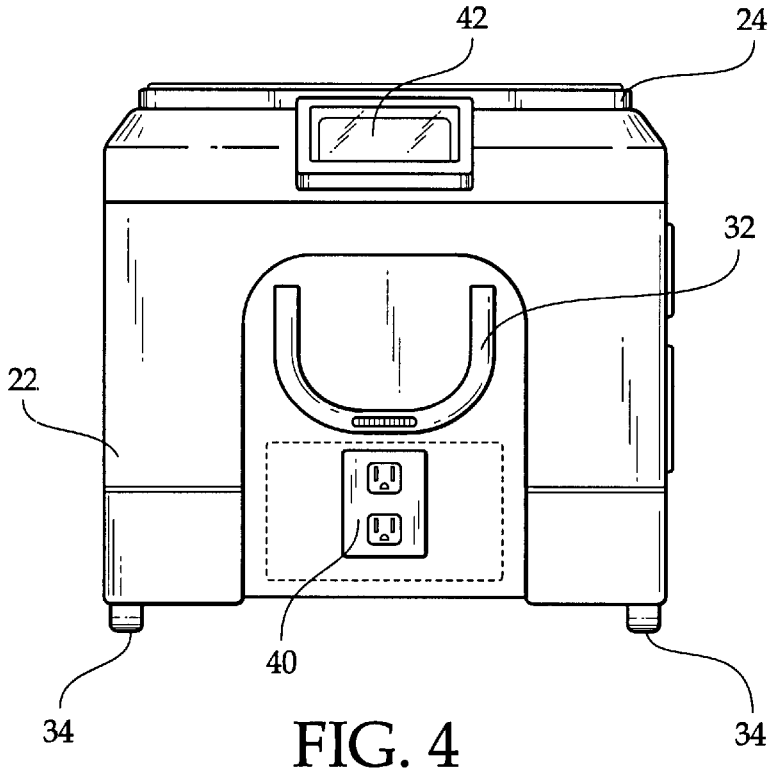
FIG. 4 is a side elevation view of the present invention.

With reference now to the drawings, and in particular, to FIGS. 1 through 4 thereof, the preferred embodiment of the new and improved cooler device with integrated solar power and stereo system embodying the principles and concepts of the present invention and generally designated by the reference number 10 will be described.

Specifically, it will be noted in the various Figures that the device relates to a cooler device with integrated solar power and stereo system for storing food items while also providing entertainment and a power source. In its broadest context, the device consists of a cooler portion, a solar panel, a storage battery, a trickle charger, a stereo system, a power outlet, a light, and a storage compartment. Such components are individually configured and correlated with respect to each other so as to attain the desired objective.

The cooler portion 12 is comprised of an open upper end 14, a closed lower end 16, a front wall 18, a rear wall 20, opposed side walls 22, and a hollow interior. The open upper end 14 has a lid 24 hingedly coupled thereto. The lid 24 is also provided with a proper latching mechanism that allows the lid 34 to be engaged to the cooler portion 12. The hollow interior is divided into a first compartment 26 and a second compartment 28. The first compartment 26 is insulated for storing food items therein. The second compartment 28 is designed for holding non-perishable items. One of the opposed side walls 22 has a drainage tube 30 extending outwardly therefrom. The drainage tube 30 is in communication with the first compartment 26. The opposed side walls 22 each have a carrying handle 32 coupled thereto. At least one of the carrying handles 32 has a thermometer 33 and compass 35 mounted therein. The closed lower end 16 has a pair of wheels 34 coupled thereto.

The solar panel 36 is secured to an upper surface of the lid 24 of the cooler portion 12. The solar panel 36 charges an internal storage battery. A trickle charger is also present to allow the internal storage battery to be charged using household current.

The stereo system 38 is disposed within the front wall 18 of the cooler portion 12. The stereo system 38 is in communication with the solar panel 36 and internal storage battery. The stereo system 38 is comprised of a receiver and a pair of speakers. Other components could be incorporated.

The power outlet 40 is disposed within one of the opposed side walls 22 of the cooler portion 12. The power outlet 40 is in communication with the solar panel 36 and internal storage battery. The power outlet 40 and associated inverter will allow for items requiring electrical power to be coupled therewith for powering.

The light 42 is secured to one of the opposed side walls 22 of the cooler portion 12. The light 42 is in communication with the solar panel 36 and internal storage battery.

The storage compartment 44 is disposed within the rear wall 20 of the cooler portion 12. The storage compartment 44 is defined by a folding door 46 having a storage compartment handle 48 secured thereto.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A cooler device with integrated solar power and stereo system for storing food items while also providing entertainment and a power source comprising, in combination:

a cooler portion comprised of an open upper end, a closed lower end, a front wall, a rear wall, opposed side walls, and a hollow interior the open upper end having a lid hingedly coupled thereto, the hollow interior being divided into a first compartment and a second compartment, the first compartment being insulated for storing food items therein, one of the opposed side walls having a drainage tube extending outwardly therefrom, the drainage tube being in communication with the first compartment, the opposed side walls each having a carrying handle coupled thereto, the closed lower end having a pair of wheels coupled thereto;

a solar panel secured to an upper surface of the lid of the cooler portion;

a stereo system disposed within the front wall of the cooler portion, the stereo system being in communication with the solar panel;

a power outlet disposed within one of the opposed side walls of the cooler portion, the power outlet being in communication with the solar panel;

a light secured to one of the opposed side walls of the cooler portion, the light being in communication with the solar panel;

a storage compartment disposed within the rear wall of the cooler portion, the storage compartment being defined by a folding door having a storage compartment handle secured thereto; and a thermometer and compass, located on at least one of the carrying handles.

2. A cooler device with integrated solar power and stereo system for storing food items while also providing entertainment and a power source comprising, in combination:

a cooler portion comprised of an open upper end, a closed lower end, a front wall, a rear wall, opposed side walls, and a hollow interior, said hollow interior being divided into a first compartment and a second compartment, the first compartment being insulated for storing food items therein, said open upper end having a lid hingedly coupled thereto, and one of the opposed side walls having a drainage tube extending outwardly therefrom, the drainage tube being in communication with the first compartment;

a solar panel secured to an upper surface of the lid of the cooler portion; and a stereo system disposed within the front wall of the cooler portion, the stereo system being in communication with the solar panel.

3. A cooler device with integrated solar power and stereo system for storing food items while also providing entertainment and a power source comprising, in combination:

a cooler portion comprised of an open upper end, a closed lower end, a front wall, a rear wall, opposed side walls, and a hollow interior the open upper end having a lid hingedly coupled thereto, said opposed side walls each having a carrying handle coupled thereto, and wherein a thermometer and a compass is located in at least one of said carrying handles;

a solar panel secured to an upper surface of the lid of the cooler portion; and a stereo system disposed within the front wall of the cooler portion, the stereo system being in communication with the solar panel.

4. A cooler device with integrated solar power and stereo system for storing food items while also providing entertainment and a power source comprising, in combination:

a cooler portion comprised of an open upper end, a closed lower end, a front wall, a rear wall, opposed side walls, and a hollow interior the open upper end having a lid hingedly coupled thereto;

a solar panel secured to an upper surface of the lid of the cooler portion;

a stereo system disposed within the front wall of the cooler portion, the stereo system being in communication with the solar panel; and a light secured to one of the opposed side walls of the cooler portion, the light being in communication with the solar panel.

* * * * *